US012108846B2

(12) United States Patent
Chan

(10) Patent No.: US 12,108,846 B2
(45) Date of Patent: Oct. 8, 2024

(54) BELT BUCKLE AND BELT

(71) Applicant: DURAFLEX HONG KONG LIMITED, HongKong (CN)

(72) Inventor: Man Chak Chan, HongKong (CN)

(73) Assignee: DURAFLEX HONG KONG LIMITED, Hong Kong (CN)

( * ) Notice: Subject to any disclaimer, the term of this patent is extended or adjusted under 35 U.S.C. 154(b) by 151 days.

(21) Appl. No.: 17/982,685

(22) Filed: Nov. 8, 2022

(65) Prior Publication Data

US 2023/0073144 A1 Mar. 9, 2023

Related U.S. Application Data

(63) Continuation of application No. PCT/CN2021/080577, filed on Mar. 12, 2021.

(30) Foreign Application Priority Data

May 12, 2020 (CN) ..... 202020780745.5

(51) Int. Cl.
*A44B 11/25* (2006.01)

(52) U.S. Cl.
CPC ..... *A44B 11/2592* (2013.01)

(58) Field of Classification Search
CPC ..... A44B 11/2592
See application file for complete search history.

(56) References Cited

U.S. PATENT DOCUMENTS 5,113,556 A * 5/1992 Murai ..... A44B 11/263 24/615
5,406,681 A * 4/1995 Olson ..... A44B 11/2561 24/579.11
6,061,883 A * 5/2000 Uehara ..... A44B 11/263 24/615
6,381,810 B2 * 5/2002 Hsieh ..... A44B 11/06 24/191
7,874,049 B2 * 1/2011 Paik ..... A44B 11/263 24/615
8,281,464 B2 * 10/2012 Shen ..... A44B 11/266 24/615

(Continued)

FOREIGN PATENT DOCUMENTS

CN 2380053 Y 5/2000
CN 205018422 U 2/2016

(Continued)

*Primary Examiner* — Jason W San
(74) *Attorney, Agent, or Firm* — IPRO, PLLC

(57) ABSTRACT

A belt buckle includes: an elastic member, a female buckle and a male buckle connected with different ends of lace. The female buckle includes a base provide with an insertion slot and a cover plate provided with a protrusion. The cover plate is mounted on the base and rotatable relative to the base. The male buckle includes an insertion block provided with a recess and a male buckle main body connected to the insertion block. When the insertion block is inserted into the insertion slot, and the protrusion extends into the recess, the female buckle and the male buckle are fastened together. When the cover plate is pressed to move towards the base, the elastic member press the cover plate to lift the cover plate in the direction away from the base to cause the protrusion to separate from the recess.

20 Claims, 6 Drawing Sheets

(56) References Cited

U.S. PATENT DOCUMENTS

| | | | | |
|---|---|---|---|---|
| 8,667,651 | B2 * | 3/2014 | Wang | A44B 11/263 24/324 |
| 8,720,018 | B2 * | 5/2014 | Yoshie | A44B 11/266 24/615 |
| D1,021,687 | S * | 4/2024 | Chan | D11/218 |
| 2007/0079486 | A1 * | 4/2007 | Paik | A44B 11/263 24/615 |
| 2009/0293243 | A1 * | 12/2009 | Yoshiguchi | A44B 11/2592 24/633 |
| 2021/0368949 | A1 * | 12/2021 | Prasitkittanai | A44C 5/2057 |
| 2023/0073144 | A1 * | 3/2023 | Chan | A44B 11/2592 |

FOREIGN PATENT DOCUMENTS

| | | | |
|---|---|---|---|
| CN | 205018424 | U | 2/2016 |
| CN | 107713187 | A | 2/2018 |
| CN | 208114135 | U | 11/2018 |
| JP | 2003093113 | A | 4/2003 |

* cited by examiner

BELT BUCKLE AND BELT

PRIORITY CLAIM

The present application claims priority to Chinese Patent Application No. 2020207807455 with the utility model title of "BELT BUCKLE AND BELT" and filed with the China National Intellectual Property Administration on May 12, 2020, which is incorporated by reference in its entirety.

TECHNICAL FIELD

Embodiments of the present application relate to the technical field of fastening accessories, and in particular, to a belt buckle and a belt.

BACKGROUND

A belt buckle generally refers to a connecting apparatus in which a pair of male buckle and female buckle connected to each other are mounted at connection belts of a canvas bag or handbag or at end portions of a belt, and is commonly used in the fields such as belts and straps. For the most commonly used belt buckle available in the market, as shown in FIG. 1, a male buckle 10 thereof is provided with two elastic jaws 11, and a female buckle 20 is provided with an insertion slot matching the elastic jaws 11. An inner wall of the insertion slot is provided with clamping holes 21 in communication with the outside. When the male buckle 10 and the female buckle 20 cooperate in use, the jaws only need to be aligned with and inserted into the insertion slot 11. The elastic jaws 11 are pressed by the inner wall of the insertion slot and shrink to the middle. After front ends of the elastic jaws 11 move to the clamping holes, the elastic jaws 11 are restored from the deformation and are clamped to the clamping holes 21 to realize the fastening of the male buckle 10 and the female buckle 20. When the fastening state of the male buckle 10 and the female buckle 20 needs to be released, the front ends of the elastic jaws 21 need to be pressed at the same time, so that the front ends of the elastic jaws 21 shrink into the insertion slot, and can the male buckle 10 be drawn out. However, when one of the elastic jaws 11 is broken by an external force, the male buckle 10 still cooperates with the female buckle 20 and swings in the insertion slot, and the phenomenon of disengagement may even occur, which is more inconvenient to use.

SUMMARY

In order to solve the above technical problems, embodiments of the present application embodiment provide a belt buckle and a belt that are easy in use.

The embodiments of the present application adopt the following technical solutions to solve the technical problems thereof:

A belt buckle, including: a female buckle, including a base and a cover plate, an insertion slot being provided in the base, the cover plate being mounted on the base, the cover plate being provided with a protrusion, the cover plate being rotatable relative to the base, and the female buckle being used to connect to one end of a lace; a male buckle, including an insertion block and a male buckle main body, the male buckle main body being connected to the insertion block, a recess being provided in the end of the insertion block facing towards the cover plate, the male buckle being used to connect to the other end of the lace; wherein when the insertion block is inserted into the insertion slot, and the protrusion extends into the recess, the female buckle and the male buckle are fastened together; and an elastic member arranged on the end of the cover plate away from the male buckle; wherein when the cover plate is pressed, one end of the cover plate moves towards the base, the elastic member presses the base, and the other end of the cover plate lifts in the direction away from the base, so as to cause the protrusion to separate from the recess.

Optionally, the base includes a bottom plate, a first side plate, a second side plate, and a connecting piece; two sides of the bottom plate are respectively connected to the first side plate and the second side plate to form the insertion slot, two ends of the connecting piece are respectively connected to the first side plate and the second side plate, the connecting piece and the bottom plate are arranged at an interval, and the connecting piece is used for winding the lace.

Optionally, the first side plate and the second side plate are in a round arch shape, and when the cover plate covers the base, the ends of the first side plate and the second side plate away from the male buckle are arranged at a distance from the cover plate, wherein when the cover plate is pressed, the cover plate is movable in a direction close to the bottom plate, so as to press the elastic member.

Optionally, the base further includes a guard rod, the first side plate and the second side plate extend outward towards one end away from the bottom plate and are connected to both ends of the guard rod, and the guard rod is located on one side of the base away from the male buckle.

Optionally, the first side plate partially extends in a direction towards the second side plate to form a first supporting plate, the second side plate partially extends in a direction towards the first side plate to form a second supporting plate, the first supporting plate and the second supporting plate are arranged symmetrically at an interval, and the first supporting plate and the second supporting plate are both located on one side of the base away from the insertion block.

Optionally, an end face of the cover plate facing the base is partially stretched to form a first guide block and a second guide block, and the first guide block and the second guide block are arranged at an interval so that a channel is formed between the first guide block and the second guide block; and the insertion block extends into the channel so that the protrusion is extendable into the recess.

Optionally, the cover plate is further provided with a supporting block, the supporting block is accommodated in the channel, and two ends of the supporting block are connected to the first guide block and the second guide block, respectively.

Optionally, the insertion block is provided with an inclined surface, one end of the insertion block is partially recessed to form the recess, and the first guide block and the second guide block are both higher than the protrusion; and when the insertion block is inserted towards the channel, the protrusion moves along the inclined surface, one end of the cover plate moves towards the bottom plate and compresses the elastic member, and after the protrusion extends into the recess, the elastic member is restored from the deformation.

Optionally, side walls of the first guide block and the second guide block are respectively provided with a first position-limiting block and a second position-limiting block, and the first side plate and the second side plate are respectively provided with a first position-limiting slot and a second position-limiting slot. When the cover plate covers the base, the first position-limiting block extends into the first position-limiting slot, the second position-limiting block extends into the second position-limiting slot, one end of the cover plate is pressed, and the first position-limiting block and the second position-limiting block rotate in the first position-limiting slot and the second position-limiting slot, respectively, so that the other end of the cover plate lifts in the direction away from the base.

Optionally, the male buckle main body includes an opening frame, and the opening frame includes a main frame block, a first sub-frame block, and a second sub-frame block. Two ends of the main frame block are respectively connected to ends of the first sub-frame block and the second sub-frame block, respectively. The other ends of the first sub-frame block and the second sub-frame block respectively extend towards a middle closing direction to form a first extension block and a second extension block. Two side surfaces of the insertion block are respectively connected to the first extension block and the second extension block. When the insertion block is inserted into the insertion slot, end portions of the first sub-frame block and the second sub-frame block both abut against the base.

Optionally, the male buckle main body further includes a connecting rod, and the first sub-frame block and the second sub-frame block extend in a direction away from the base to form a first abutting block and a second abutting block. Two ends of the connecting rod are respectively connected to the first abutting block and the second abutting block.

Optionally, one surface of the insertion block facing the base is a bottom surface of the insertion block, end faces of the first sub-frame block and the second sub-frame block away from the bottom surface of the insertion block are higher than the bottom surface of the insertion block, and one end of the base close to the male buckle extends outward to form a guide piece. When the insertion block is inserted into the female buckle, one end face of the guide piece and the bottom surface of the insertion block slide relative to each other, and the guide piece is embedded between the first extension block and the second extension block.

Optionally, ends of the first side plate and the second side plate facing the male buckle extend outward, respectively forming a first extension portion and a second extension portion, and when the female buckle and the male buckle are fastened together, the first extension portion and the second extension portion respectively abut against the first sub-frame block and the second sub-frame block.

The embodiments of the present application adopt the following technical solutions to solve the technical problems thereof:

A belt includes the above belt buckle and a lace, one end of the lace is connected to the female buckle, and the other end of the lace is connected to the male buckle.

BRIEF DESCRIPTION OF THE DRAWINGS

One or more embodiments are exemplified by pictures in corresponding accompanying drawings, these exemplifications do not constitute limitations of the embodiments, and elements with identical reference numerals in the accompanying drawings are denoted as similar elements. Unless otherwise stated, figures in the accompanying drawings do not constitute a scale limitation.

DETAILED DESCRIPTION

In order to facilitate the understanding of the present application, the present application will be described in more detail below with reference to the accompanying drawings and specific embodiments. It should be noted that when an element is expressed as being "fixed to" another element, it may be directly on the other element, or one or more intervening elements may exist therebetween. When an element is expressed as being "connected" to another element, it may be directly connected to the other element, or one or more intervening elements may exist therebetween. Orientation or position relationships indicated by terms such as "up," "down," "inside," "outside," "vertical," and "horizontal" used in this specification are based on the orientation or position relationships shown in the accompanying drawings, which are only for the convenience of describing the present application and simplifying the description, rather than indicating or implying that the apparatus or element referred to must have a specific orientation, or be constructed and operated in a specific orientation. Therefore, it should not be construed as a limitation on the present application. Furthermore, the terms "first," "second," and the like are used for descriptive purposes only and should not be construed to indicate or imply relative importance.

Unless otherwise defined, all technical and scientific terms used in this specification have the same meaning as commonly understood by those of ordinary skill in the technical field belonging to this application. The terms used in the specification of the present application are only for the purpose of describing specific embodiments, and are not used for limiting the present application. As used in this specification, the term "and/or" includes any and all combinations of one or more of associated listed items.

In addition, the technical features involved in the different embodiments of the present application described below may be combined with each other as long as there is no conflict with each other.

Figure 1:
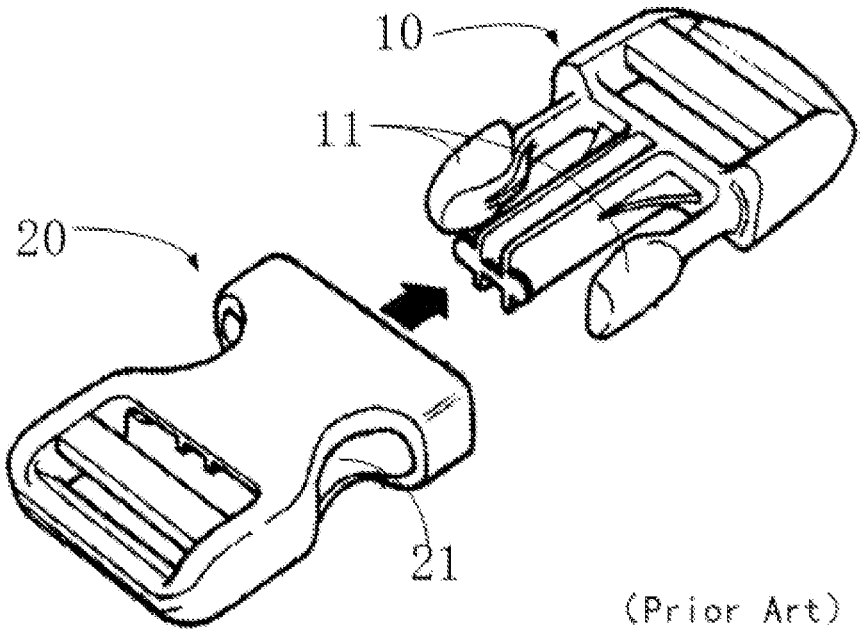
FIG. 1 is a schematic structural diagram of an existing belt buckle.
Figure 2:
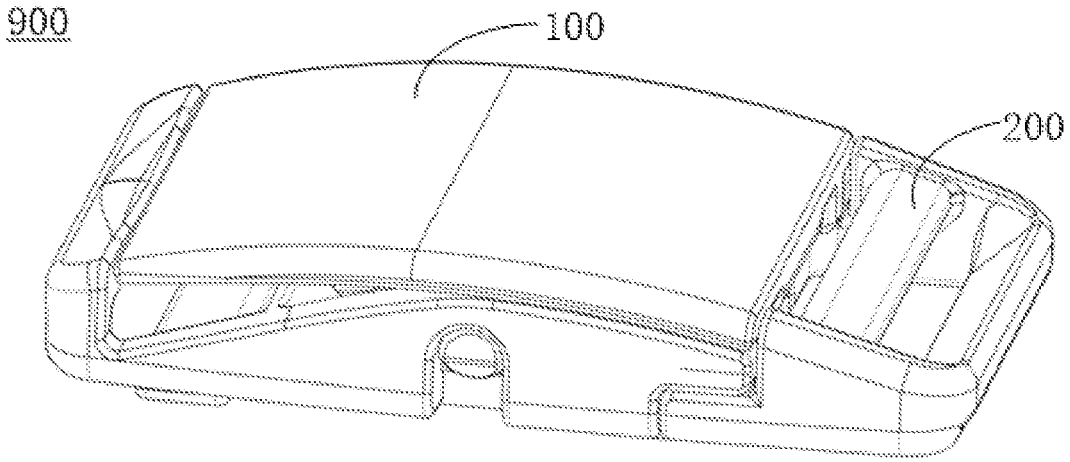
FIG. 2 is a schematic diagram of a belt buckle according to an embodiment of the present application.
Figure 3:
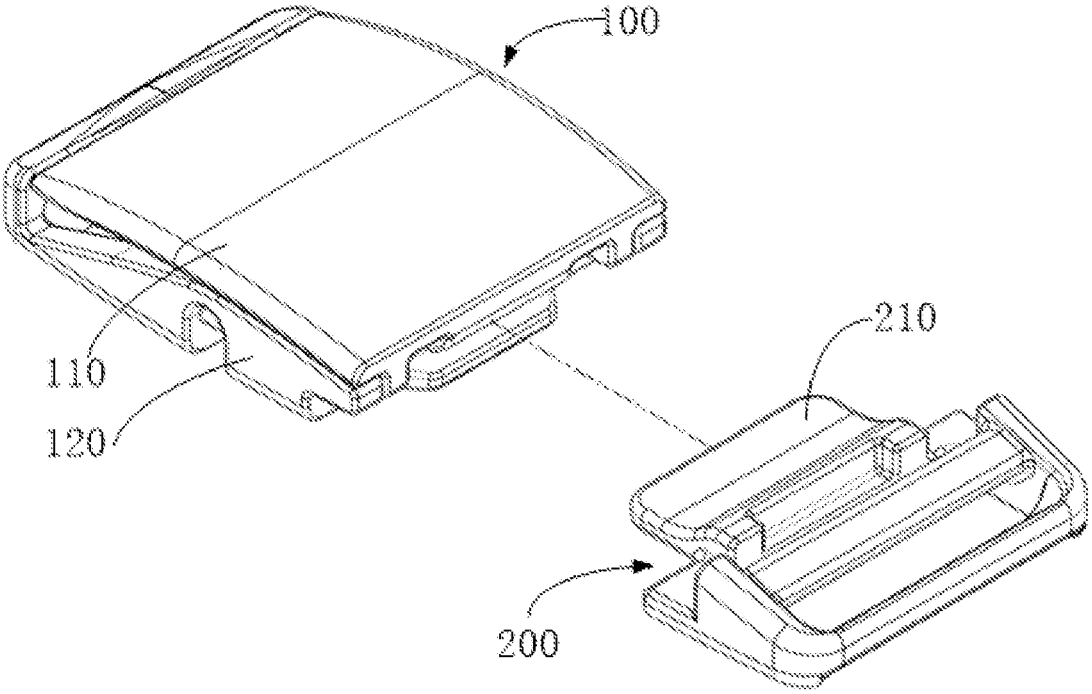
FIG. 3 is a structural exploded diagram of FIG. 2.
Figure 4:
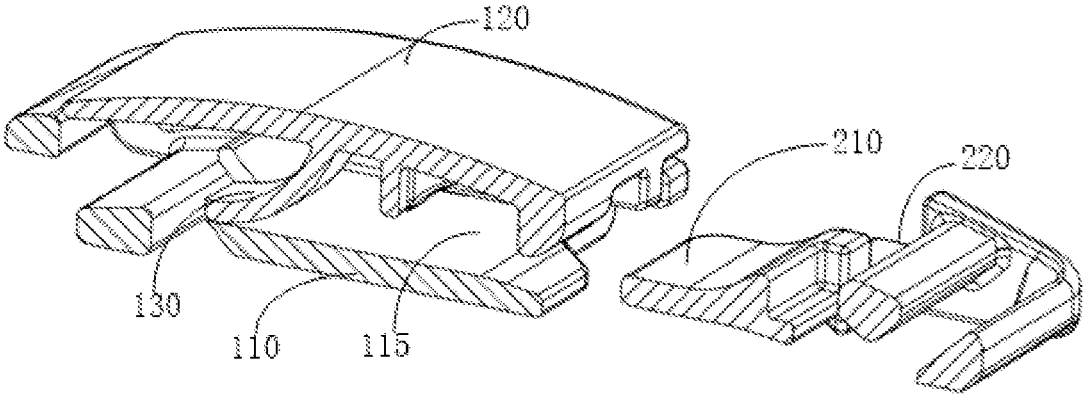
FIG. 4 is a sectional diagram of FIG. 3.

As shown in FIG. 2 to FIG. 4, a belt buckle 900 provided by one of the embodiments of the present application includes a female buckle 100 and a male buckle 200. The female buckle 100 may be fastened to the male buckle 200, and the female buckle 100 is used to connect to one end of a lace. The male buckle 200 is used to connect to the other end of the lace.

The female buckle 100 includes a base 110, a cover plate 120, and an elastic member 130. The base 110 is mounted to fit the cover plate 120, and the elastic member 130 is arranged on one side of the cover plate 120 facing towards the base 110, wherein the cover plate 120 can swing relative to the base 110. One end of the cover plate 120 is pressed so that the elastic member 130 and the base 110 press each other, and the other end of the cover plate 120 swings in a direction away from the base 110.

Figure 5:
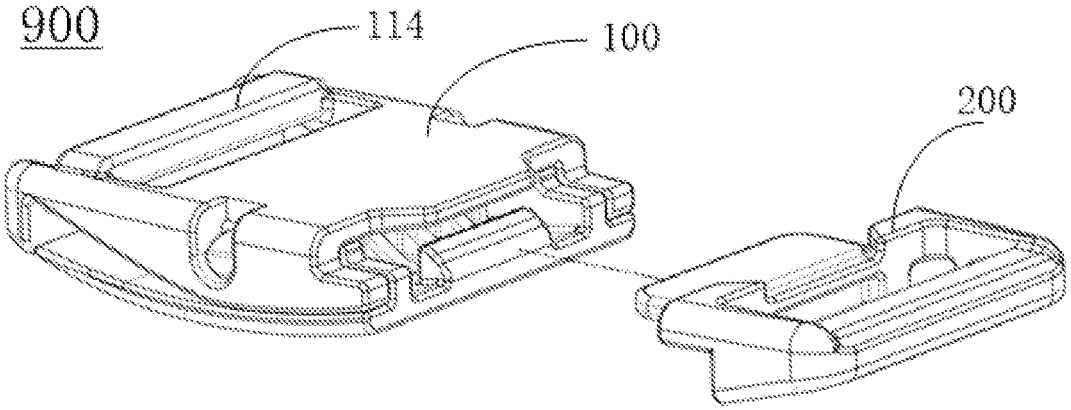
FIG. 5 is a schematic diagram from another perspective of FIG. 3.
Figure 6:
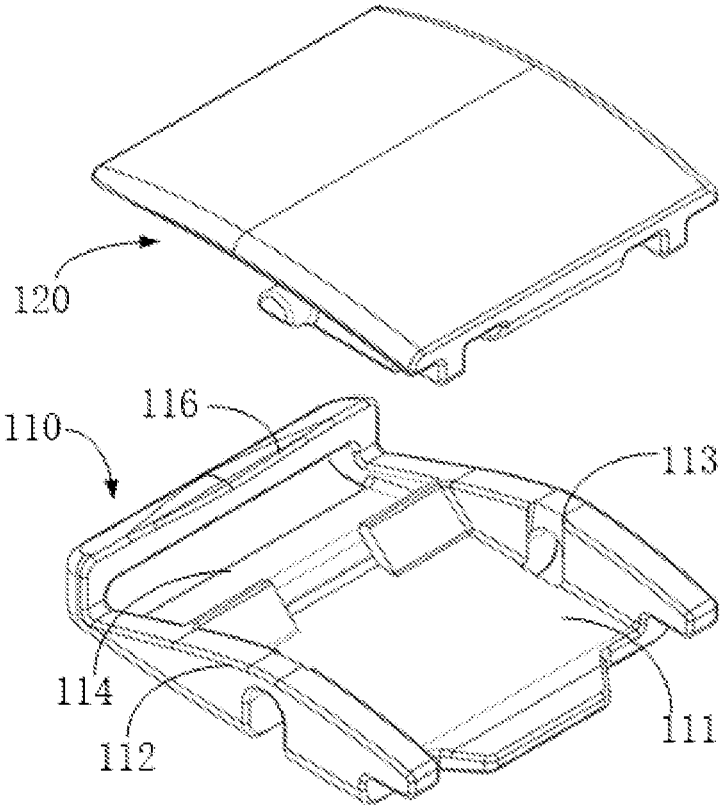
FIG. 6 is a structural exploded diagram of a female buckle of FIG. 3.
Figure 7:
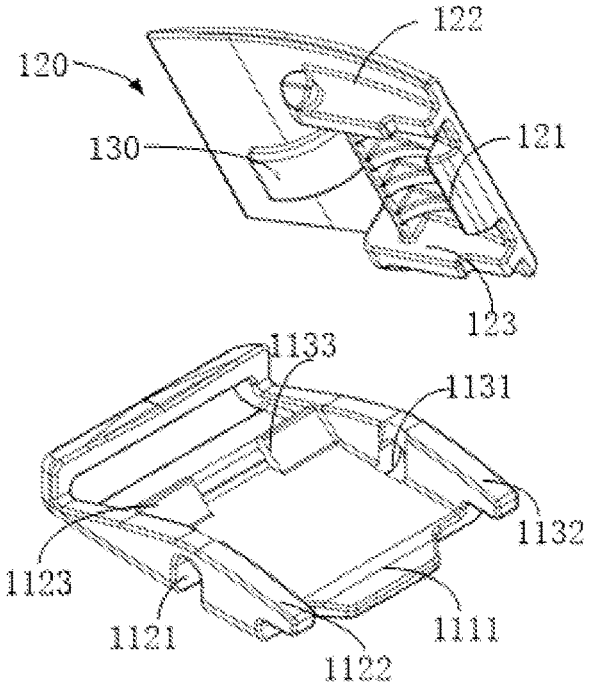
FIG. 7 is another structural exploded diagram of the female buckle of FIG. 3.

According to FIG. 5 to FIG. 7, the base 110 includes a bottom plate 111, a first side plate 112, a second side plate 113, and a connecting piece 114. Both sides of the bottom plate 111 are connected to the first side plate 112 and the second side plate 113 respectively to form the insertion slot 115. Two ends of the connecting piece 114 are respectively connected to the first side plate 112 and the second side plate 113, end portions of the connecting piece 114 and the bottom plate 111 are arranged at an interval, and the connecting piece 114 is used for winding the lace.

In some embodiments, the first side plate 112 and the second side plate 113 are in a round arch shape, and when the cover plate 120 covers the base 110, the ends of the first side plate 112 and the second side plate 113 away from the male buckle 200 are arranged at a distance from the cover plate 120, the cover plate 120 is pressed, and the cover plate 120 is movable in a direction close to the bottom plate 111, so as to press the elastic member 130.

In some embodiments, the side walls of the first side plate 112 and the second side plate 113 are respectively provided with a first position-limiting slot 1121 and a second position-limiting slot 1131, and the first position-limiting slot 1121 and the second position-limiting slot 1131 are symmetrically arranged. It is understandable that the first position-limiting slot 1121 and the second position-limiting slot 1131 may be in a circular shape or an arch shape, and of course, may also be in other shapes. Preferably, the first position-limiting slot 1121 and the second position-limiting slot 1131 are in an arch shape.

In some embodiments, ends of the first side plate 112 and the second side plate 113 close to the male buckle 200 extend outward to form a first extension portion 1122 and a second extension portion 1132, respectively.

In some embodiments, one end of the bottom plate 111 close to the male buckle 200 extends outward and forms a guide piece 1111.

In some embodiments, in order to enhance the strength of the female buckle 100, the first side plate 112 partially extends in a direction towards the second side plate 113 to form a first supporting plate 1123, and the second side plate 113 partially extends in a direction towards the first side plate 112 to form a second supporting plate 1133, the first supporting plate 1123 and the second supporting plate 1133 are arranged symmetrically at an interval, and the first supporting plate 1123 and the second supporting plate 1133 are both located on one side of the base 110 away from the male buckle 200. It is understandable that when the cover plate 120 is subjected to an external force, it swings towards the bottom plate 111 and presses the elastic member 130. After the cover plate 120 swings by a certain angle, the cover plate 120 abuts against the first supporting plate 1122 and the second supporting plate 1132, so as to prevent the cover plate 120 from breaking the elastic member 130 after subjected to the force.

In some embodiments, the base 110 further includes a guard rod 116, the first side plate 112 and the second side plate 113 extend outward towards one end away from the bottom plate 111 and are connected to both ends of the guard rod 116, and the guard rod 116 is located on one side of the base 110 away from the male buckle 200.

Figure 8:
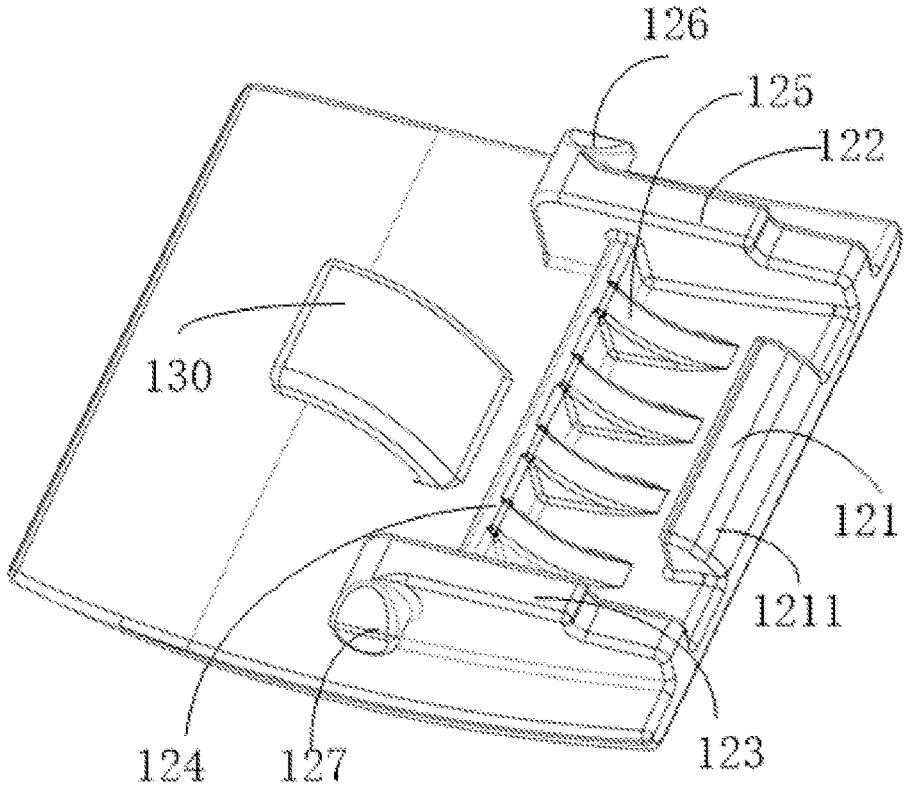
FIG. 8 is a schematic structural diagram of a cover plate in FIG. 7.

Referring to FIG. 7 and FIG. 8, one end face of the cover plate 120 is partially stretched outward to form a protrusion 121, a first guide block 122, and a second guide block 123. The first guide block 122 and the second guide block 123 are arranged at an interval so that a channel is formed between the first guide block 122 and the second guide block 123. The protrusion 121 is located between the first guide block 122 and the second guide block 123. Preferably, one side of the protrusion 121 transitions from the end portion of the cover plate 120 to the side where the elastic member 130 is located, so as to form an arc surface 1211.

In some embodiments, both the first guide block 122 and the second guide block 123 are higher than the protrusion 121. Of course, the first guide block 122 and the second guide block 123 may also be as high as the protrusion 121. In this embodiment, both the first guide block 122 and the second guide block 123 are higher than the protrusion 121.

Further, the cover plate 120 is further provided with a supporting block 124, the supporting block 124 is accommodated in the channel, two ends of the supporting block are respectively connected to the first guide block 122 and the second guide block 123, and the supporting block 124 is located between the protrusion 121 and the elastic member 130.

Further, the cover plate 120 is further provided with a plurality of ribbed plates 125, one side of the ribbed plate 125 is connected to one side of the supporting block 124, and the other side of the ribbed plate 125 is connected to an end face of the cover plate 120.

In some embodiments, one side of the first guide block 122 away from the second guide block 123 is provided with a first position-limiting block 126, one side of the second guide block 123 away from the first guide block 122 is provided with a second position-limiting block 127, and the first position-limiting block 126 and the second position-limiting block 127 are symmetrically arranged.

The elastic member 130 is arranged at one end of the cover plate 120 and is located at one end of the first guide block 122 or the second guide block 123 away from the protrusion 121. In this embodiment, the elastic member 130 is an elastic sheet bent in a direction away from the protrusion 121, one end of the elastic sheet is connected to the cover plate 120, and the other end is used for abutting against the base 110. In other embodiments, the elastic member 130 may also be a spring, one end of the spring is fixedly connected to the cover plate 120, and the other end of the spring is used for abutting against the base. Of course, the elastic member may also be another structure, as long as when the cover plate 120 is pressed, one end of the cover plate 120 may press the elastic member 130 and the other end of the cover plate 120 is lifted.

When the base 110 is mounted to fit the cover plate 120, the first position-limiting block 126 and the second position-limiting block 127 extend into the first position-limiting slot 1121 and the second position-limiting slot 1131, respectively. The first position-limiting block 126 and the second position-limiting block 127 rotate synchronously in the first position-limiting slot 1121 and the second position-limiting slot 1131 respectively, so that the two ends of the cover plate 120 swing relative to the base 110. The other end of the elastic member 130 abuts against the bottom plate 111. When the cover plate 120 is pressed to close to one side of the elastic member, the elastic member 130 presses the bottom plate 111, and the side of the cover plate 120 away from the elasticity lifts in a direction away from the bottom plate 111, so that the position of the protrusion 121 changes accordingly.

Figure 9:
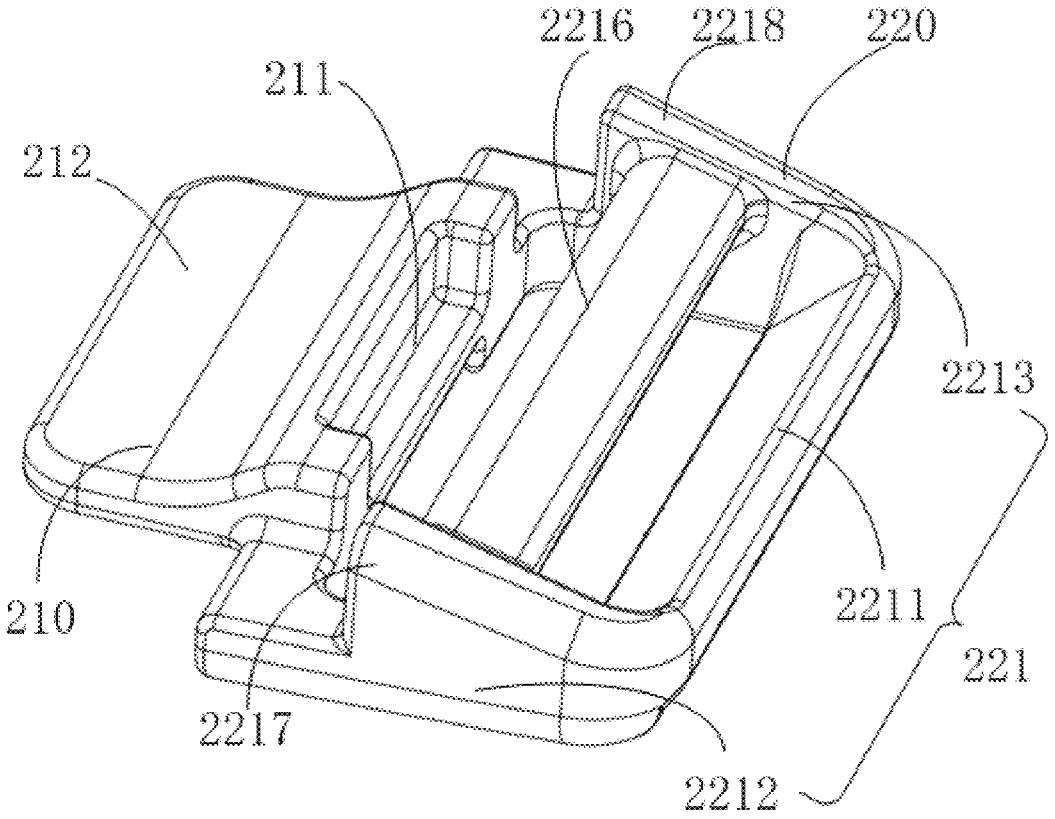
FIG. 9 is a schematic structural diagram of a male buckle in FIG. 3.
Figure 10:
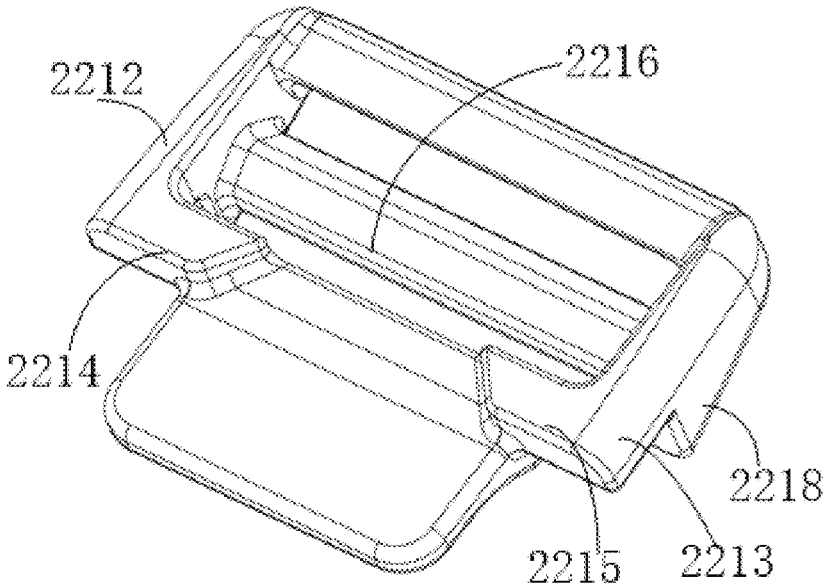
FIG. 10 is a schematic diagram from another perspective of FIG. 9.

Referring to FIG. 9 and FIG. 10, in some embodiments, the male buckle 200 includes an insertion block 210 and a male buckle main body 220. The male buckle main body 220 is connected to the insertion block 210. One end of the insertion block 210 is recessed inward to form a recess 211, and the insertion block 210 is provided with an inclined surface 212. Specifically, when the male buckle 200 is fitted with the female buckle 100, the insertion block 210 is inserted into the insertion slot 115, and the protrusion 121 extends into the recess 211, so that the female buckle 100 and the male buckle 200 are fastened together.

In some embodiments, the male buckle main body 220 includes an opening frame 221, and the opening frame 221 includes a main frame block 2211, a first sub-frame block 2212, and a second sub-frame block 2213. Two ends of the main frame block 2211 are respectively connected to ends of the first sub-frame block 2212 and the second sub-frame block 2213, respectively. The other ends of the first sub-frame block 2212 and the second sub-frame block 2213 respectively extend towards a middle closing direction to form a first extension block 2214 and a second extension block 2215. Two side surfaces of the insertion block 210 are respectively connected to the first extension block 2214 and the second extension block 2215.

Further, the male buckle main body 220 further includes a connecting rod 2216, and the first sub-frame block 2212 and the second sub-frame block 2213 extend to one end to form a first abutting block 2217 and a second abutting block 2218. Two ends of the connecting rod 2216 are respectively connected to the first abutting block 2217 and the second abutting block 2218.

Specifically, during use, when the insertion block 210 is inserted into the female buckle 100 towards the channel, the protrusion 121 abuts against the inclined surface 212 and moves along the inclined surface 212. The protrusion 121 is gradually lifted by the insertion block 210. Limited by the first position-limiting slot 1121 and the second position-limiting slot 1131, the first position-limiting block 126 and the second position-limiting block 127 rotate in the slot. The side of the cover plate 120 close to the elastic member 130 downward-presses the elastic member 130 towards the bottom plate 111. After the protrusion 121 extends into the recess 211, the elastic member is restored from the deformation. The side of the cover plate 120 close to the male buckle 200 moves in the direction towards the base 110, and the cover plate 120 returns to its original position, thereby realizing fastening together of the male buckle 200 and the female buckle 100.

It is understandable that, in order to facilitate the docking of the female buckle 100 and the male buckle 200, when the insertion block 210 extends into the insertion slot 115, the guide piece 1111 slides tightly close to a bottom surface of the insertion block 210 away from the inclined surface 212. When the first extension block 2214 and the second extension block 2215 respectively abut against end portions of the first side plate 112 and the second side plate 113, the protrusion 121 is exactly embedded in the recess 211. At this moment, the two ends of the guide piece 1111 respectively abut against the first extension block 2214 and the second extension block 2215. The first abutting block 2217 abuts against the first extension portion 1122 and the end portion of the cover plate 120, and the second abutting block 2218 abuts against the second extension portion 1132 and the end portion of the cover plate 120. The above structure guarantees the tight fit between the female buckle 100 and the male buckle 200.

On the other hand, when the cover plate 120 is pressed to close to one side of the elastic member 130, the elastic member 130 and the base 110 press each other, and the other side of the cover plate 120 will be lifted in the direction away from the bottom plate 111. After the elastic member 130 is pressed to a certain degree, the protrusion 121 is released from the recess 211, and at this moment, the male buckle 200 is pulled in the direction away from the female buckle 100, and the fastening relationship of the male buckle 200 and the female buckle 100 is released.

Through the structure, the male buckle 200 only needs to use the insertion block 210 inserted into the insertion slot in the female buckle 100, and the fitted mounting of the female buckle 100 and the male buckle 200 can be quickly realized. When it is necessary to release the fastening relationship between the female buckle 100 and the male buckle 200, the separation of the two may be achieved by pressing the cover plate 120 and drawing and pulling the male buckle 200. Therefore, the docking and separation of the female buckle 100 and the male buckle 200 are convenient and fast.

The belt buckle 900 provided by the embodiments of the present application includes: a female buckle 100, including a base 110 and a cover plate 120, an insertion slot 115 being provided in the base 110, the cover plate 120 being mounted on the base 110, the cover plate 120 being provided with a protrusion 121, the cover plate 120 being rotatable relative to the base 110, and the female buckle 100 being used to connect to one end of a lace; a male buckle 200, including an insertion block 210 and a male buckle main body 220, the male buckle main body 220 being connected to the insertion block 210, a recess 211 being provided in the end of the insertion block 210 facing towards the cover plate 120, the male buckle 200 being used to connect to the other end of the lace, wherein when the insertion block 210 is inserted into the insertion slot 115, and the protrusion 121 extends into the recess 211, the female buckle 100 and the male buckle 200 are fastened together; and an elastic member 130 arranged on the end of the cover plate 120 away from the male buckle 200. Therefore, when the cover plate 120 is pressed, one end of the cover plate 120 moves towards the base 110, the elastic member 130 presses the base 110, and the other end of the cover plate 120 lifts in the direction away from the base 110, so as to cause the protrusion 121 to separate from the recess 211, which is more convenient in use. Meanwhile, after a front end portion of the insertion block 210 is broken, as long as the recess 211 still exists, the female buckle 100 and the male buckle 200 can still fit each other.

Figure 11:
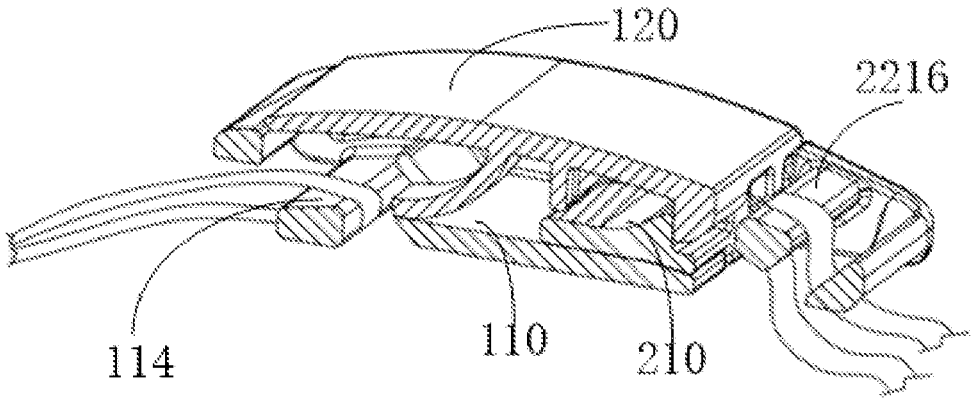
FIG. 11 is a structural sectional diagram of a belt according to another embodiment of the present application.

As shown in FIG. 11, a belt (not shown) provided by another embodiment of the present application includes the belt buckle 900 of the above embodiment and a lace (not shown), one end of the lace is connected to the female buckle, and the other end of the lace is connected to the male buckle.

It is understandable that one end of the lace may be tied to the connecting piece 114 of the female buckle 100, and of course may also be tied to other positions of the female buckle 100. In this embodiment, the lace is tied to the connecting piece 114. Similarly, the other end of the lace may be tied to the connecting rod 2216 or other positions of the male buckle 200, such as the main frame block 2211. Preferably, the other end of the lace is tied to the connecting rod 2216.

The above descriptions are only implementations of the present application, and are not intended to limit the patent scope of the present application. Any equivalent structure or equivalent process transformation made by using the contents of the specification and drawings of the present application, or those directly or indirectly applied to other related technical fields, are similarly included within the patent protection scope of the present application.

What is claimed is:

1. A belt buckle, comprising:

a female buckle, comprising a base and a cover plate, an insertion slot being provided in the base, the cover plate being mounted on the base, the cover plate being provided with a protrusion, the cover plate being rotatable relative to the base, and the female buckle being used to connect to one end of a lace;

a male buckle, comprising an insertion block and a male buckle main body, the male buckle main body being connected to the insertion block, a recess being provided in the end of the insertion block facing towards the cover plate, the male buckle being used to connect to the other end of the lace; wherein when the insertion block is inserted into the insertion slot, and the protrusion extends into the recess, the female buckle and the male buckle are fastened together; and an elastic member arranged on the end of the cover plate away from the male buckle;

wherein when the cover plate is pressed, one end of the cover plate moves towards the base, the elastic member presses the base, and the other end of the cover plate lifts in the direction away from the base, so as to cause the protrusion to separate from the recess.

2. The belt buckle according to claim 1, wherein the base comprises a bottom plate, a first side plate, a second side plate, and a connecting piece;

two sides of the bottom plate are respectively connected to the first side plate and the second side plate to form the insertion slot, two ends of the connecting piece are respectively connected to the first side plate and the second side plate, the connecting piece and the bottom plate are arranged at an interval, and the connecting piece is used for winding the lace.

3. The belt buckle according to claim 2, wherein the first side plate and the second side plate are in a round arch shape, and when the cover plate covers the base, the ends of the first side plate and the second side plate away from the male buckle are arranged at a distance from the cover plate, wherein when the cover plate is pressed, the cover plate is movable in a direction close to the bottom plate, so as to press the elastic member.

4. The belt buckle according to claim 2, wherein the base further comprises a guard rod, the first side plate and the second side plate extend outward towards one end away from the bottom plate and are connected to both ends of the guard rod, and the guard rod is located on one side of the base away from the male buckle.

5. The belt buckle according to claim 4, wherein the first side plate partially extends in a direction towards the second side plate to form a first supporting plate, the second side plate partially extends in a direction towards the first side plate to form a second supporting plate, the first supporting plate and the second supporting plate are arranged symmetrically at an interval, and the first supporting plate and the second supporting plate are both located on one side of the base away from the insertion block.

6. The belt buckle according to claim 2, wherein an end face of the cover plate facing the base is partially stretched to form a first guide block and a second guide block, and the first guide block and the second guide block are arranged at an interval so that a channel is formed between the first guide block and the second guide block; and the insertion block extends into the channel so that the protrusion is extendable into the recess.

7. The belt buckle according to claim 6, wherein the cover plate is further provided with a supporting block, the supporting block is accommodated in the channel, and two ends of the supporting block are connected to the first guide block and the second guide block, respectively.

8. The belt buckle according to claim 7, wherein the insertion block is provided with an inclined surface, one end of the insertion block is partially recessed to form the recess, and the first guide block and the second guide block are both higher than the protrusion; and when the insertion block is inserted towards the channel, the protrusion moves along the inclined surface, one end of the cover plate moves towards the bottom plate and compresses the elastic member, and after the protrusion extends into the recess, the elastic member is restored from the deformation.

9. The belt buckle according to claim 6, wherein side walls of the first guide block and the second guide block are respectively provided with a first position-limiting block and a second position-limiting block, and the first side plate and the second side plate are respectively provided with a first position-limiting slot and a second position-limiting slot, when the cover plate covers the base, the first position-limiting block extends into the first position-limiting slot, the second position-limiting block extends into the second position-limiting slot, one end of the cover plate is pressed, and the first position-limiting block and the second position-limiting block rotate in the first position-limiting slot and the second position-limiting slot, respectively, so that the other end of the cover plate lifts in the direction away from the base.

10. The belt buckle according to claim 2, wherein the male buckle main body comprises an opening frame, and the opening frame comprises a main frame block, a first sub-frame block, and a second sub-frame block, two ends of the main frame block are respectively connected to ends of the first sub-frame block and the second sub-frame block, respectively, the other ends of the first sub-frame block and the second sub-frame block respectively extend towards a middle closing direction to form a first extension block and a second extension block, two side surfaces of the insertion block are respectively connected to the first extension block and the second extension block, and when the insertion block is inserted into the insertion slot, end portions of the first sub-frame block and the second sub-frame block both abut against the base.

11. The belt buckle according to claim 10, wherein the male buckle main body further comprises a connecting rod, the first sub-frame block and the second sub-frame block extend in a direction away from the base to form a first abutting block and a second abutting block, and two ends of the connecting rod are respectively connected to the first abutting block and the second abutting block.

12. The belt buckle according to claim 10, wherein one surface of the insertion block facing the base is a bottom surface of the insertion block, end faces of the first sub-frame block and the second sub-frame block away from the bottom surface of the insertion block are higher than the bottom surface of the insertion block, and one end of the base close to the male buckle extends outward to form a guide piece; and when the insertion block is inserted into the female buckle, one end face of the guide piece and the bottom surface of the insertion block slide relative to each other, and the guide piece is embedded between the first extension block and the second extension block.

13. The belt buckle according to claim 11, wherein ends of the first side plate and the second side plate facing the male buckle extend outward, respectively forming a first extension portion and a second extension portion, and when the female buckle and the male buckle are fastened together, the first extension portion and the second extension portion respectively abut against the first abutting block and the second abutting block.

14. A belt, comprising a belt buckle and a lace, wherein the belt buckle comprises:

a female buckle, comprising a base and a cover plate, an insertion slot being provided in the base, the cover plate being mounted on the base, the cover plate being provided with a protrusion, the cover plate being rotatable relative to the base;

a male buckle, comprising an insertion block and a male buckle main body, the male buckle main body being connected to the insertion block, a recess being provided in the end of the insertion block facing towards the cover plate; wherein when the insertion block is inserted into the insertion slot, and the protrusion extends into the recess, the female buckle and the male buckle are fastened together; and an elastic member arranged on the end of the cover plate away from the male buckle;

wherein one end of the lace is connected to the female buckle, and the other end of the lace is connected to the male buckle, and when the cover plate is pressed, one end of the cover plate moves towards the base, the elastic member presses the base, and the other end of the cover plate lifts in the direction away from the base, so as to cause the protrusion to separate from the recess.

15. The belt according to claim 14, wherein the base comprises a bottom plate, a first side plate, a second side plate, and a connecting piece;

two sides of the bottom plate are respectively connected to the first side plate and the second side plate to form the insertion slot, two ends of the connecting piece are respectively connected to the first side plate and the second side plate, the connecting piece and the bottom plate are arranged at an interval, and the connecting piece is used for winding the lace.

16. The belt according to claim 15, wherein the first side plate and the second side plate are in a round arch shape, and when the cover plate covers the base, the ends of the first side plate and the second side plate away from the male buckle are arranged at a distance from the cover plate, wherein when the cover plate is pressed, the cover plate is movable in a direction close to the bottom plate, so as to press the elastic member.

17. The belt according to claim 15, wherein the base further comprises a guard rod, the first side plate and the second side plate extend outward towards one end away from the bottom plate and are connected to both ends of the guard rod, and the guard rod is located on one side of the base away from the male buckle.

18. The belt according to claim 17, wherein the first side plate partially extends in a direction towards the second side plate to form a first supporting plate, the second side plate partially extends in a direction towards the first side plate to form a second supporting plate, the first supporting plate and the second supporting plate are arranged symmetrically at an interval, and the first supporting plate and the second supporting plate are both located on one side of the base away from the insertion block.

19. The belt according to claim 15, wherein an end face of the cover plate facing the base is partially stretched to form a first guide block and a second guide block, and the first guide block and the second guide block are arranged at an interval so that a channel is formed between the first guide block and the second guide block; and the insertion block extends into the channel so that the protrusion is extendable into the recess.

20. The belt according to claim 19, wherein the cover plate is further provided with a supporting block, the supporting block is accommodated in the channel, and two ends of the supporting block are connected to the first guide block and the second guide block, respectively.

* * * * *